US005193979A

United States Patent [19]

Suin

[11] Patent Number: 5,193,979

[45] Date of Patent: Mar. 16, 1993

[54] WIND FORCE-OPERATED CYCLING ORNAMENT

[76] Inventor: Huang-Kuang Suin, 4Fl., 1-44, No. 1, Hsin Yi Road, Sec. 4, Taipei, Taiwan

[21] Appl. No.: 801,355

[22] Filed: Dec. 2, 1991

[51] Int. Cl.[5] ..... B63H 1/00

[52] U.S. Cl. ..... 416/61; 416/146 R; 40/422

[58] Field of Search ..... 40/420, 422; 416/61, 416/146 R

[56] References Cited

U.S. PATENT DOCUMENTS

| | | | |
|---|---|---|---|
| D. 160,364 | 10/1950 | Brown | 416/61 X |
| 439,866 | 11/1890 | Devore | 40/422 |
| 1,019,245 | 3/1912 | Geels | 40/420 X |
| 1,603,467 | 10/1926 | Irick | 40/420 X |
| 2,405,376 | 8/1946 | Stubbins | 40/420 X |

*Primary Examiner*—Edward K. Look

*Assistant Examiner*—Todd Mattingly

*Attorney, Agent, or Firm*—Varndell Legal Group

[57] ABSTRACT

A wind force-operated cycling ornament, comprising a body shaped like a cyclist and mounted on a base, which can be mounted on a flat surface by screws or a double-sided adhesive tape, two wheels mounted on said body at two opposite sides and connected by a wheel axle, a fan mounted on said body and forced by the power of wind to rotate said wheels through a transmission gear set, and a pair of driven plates and a pair of driving plates movably mounted between a pair of pegs on said body and two contact points on said wheel, and wherein said driven plates are respectively shaped like the upper part of the leg, and said driving plates are respectively shaped like the lower part of the leg; rotating said fan causes said driven and driving plates to alternatively rotate back and forth.

1 Claim, 3 Drawing Sheets

WIND FORCE-OPERATED CYCLING ORNAMENT

BACKGROUND AND SUMMARY OF THE INVENTION

The present invention relates to an ornament and relates more particularly to such an ornament which comprises a toy cyclist riding on two transmission wheels which turn by the power of wind through the operation of a fan.

In the preferred embodiment of the present invention, the cycling ornament comprises a body shaped like a cyclist and supported on a base, two transmission wheels mounted on the body at two opposite sides by a wheel axle, a fan inserted through a bearing and connected to either transmission wheel through a worm and a gear, two driven plates and two driving plates connected between two pegs on the body and the two transmission wheels. The driven plates which are respectively shaped like the upper part of the leg are respectively revolvably connected to the pegs, and the driving plates which are respectively shaped like the lower part of the leg are respectively revolvably connected to the driven plates. Rotating the fan causes the driven and driving plates to alternatively rotate back and forth like the two legs of a cyclist pedaling on a bicycle.

DETAILED DESCRIPTION OF THE PREFERRED EMBODIMENT

Figure 1:
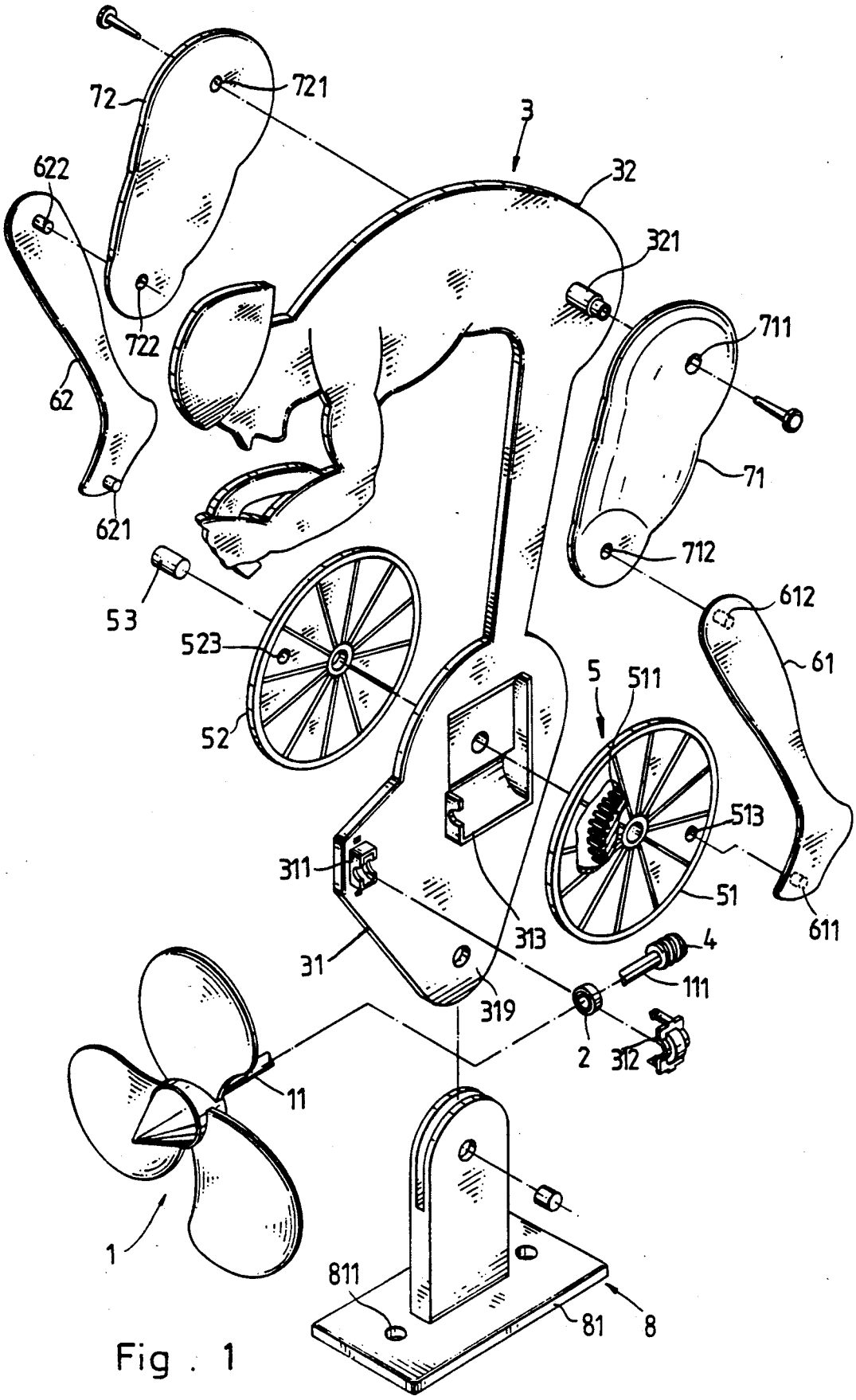
FIG. 1 is an exploded perspective view of the preferred embodiment of the present invention.

Referring to the annexed drawings in detail, therein illustrated is a wind force-operated cycling ornament embodying the present invention which is generally comprised of a body 3 mounted on a base 8, a transmission wheel set 5 mounted on said body 3 and driven by a fan 1 to alternatively rotate a pair of driven plates 71, 72 through a pair of driving plates 61, 62.

Figure 2:
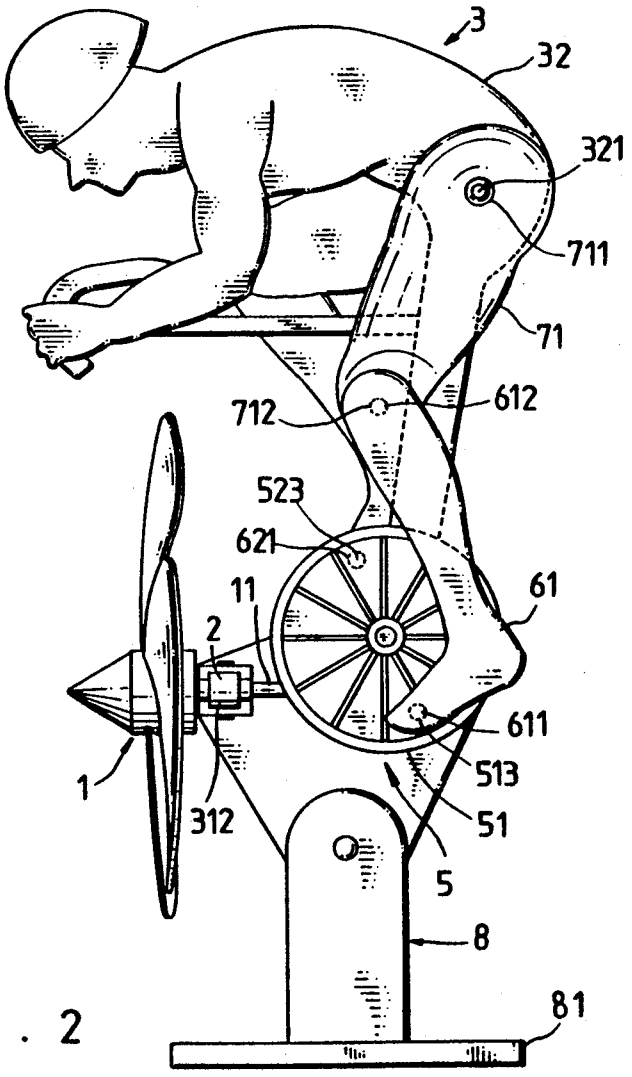
FIG. 2 is a side assembly view thereof.
Figure 3:
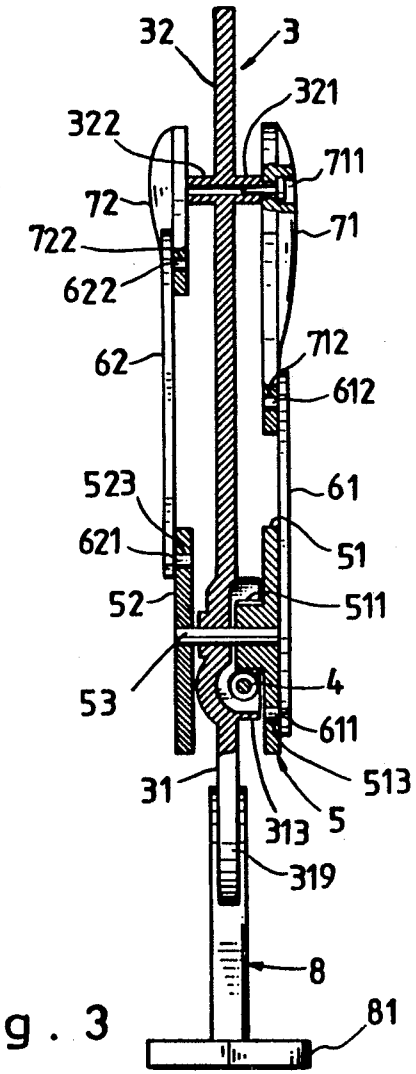
FIG. 3 is a sectional rear view thereof.
Figure 5:
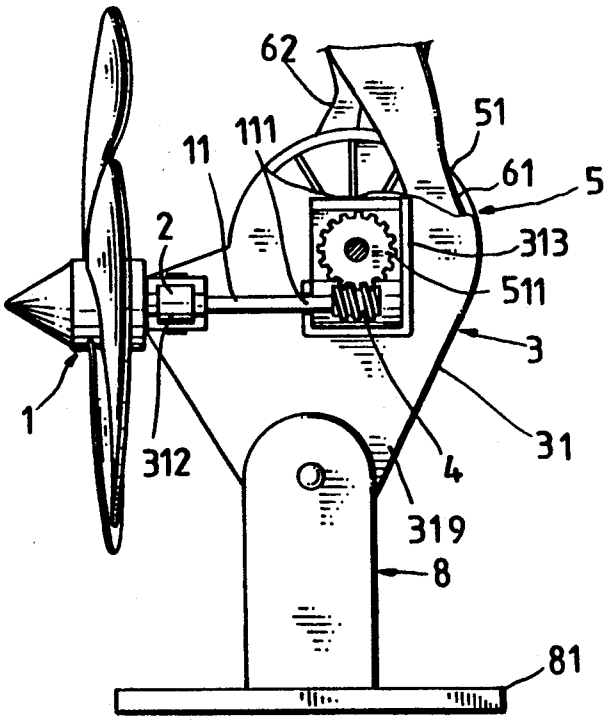
FIG. 5 is a partly sectional view showing the transmission of the power of wind through the shaft of the fan to the wheels via a worm and a gear.

Referring to FIGS. 1 through 3 again, the body 3 comprises an upper part 32 extending from a lower part 31, wherein the upper part 32 is shaped like the upper part of a cyclist and has two pegs 321 aligned at two opposite sides for holding the two driven plates 71, 72. The lower part 31 has a lower end 319 fastened in a hole on the base 8, a bearing holder 311, 312 at the front end thereof to hold a bearing 2, and a seat 313 at the middle for mounting the transmission wheel set 5. The bearing holder 311, 312 can be opened and then closed for fastening the fan 1. The fan 1 has a shaft 11 inserted through the bearing 2 in the bearing holder 311, 312. The rear end 111 of the shaft 11 is coupled with a worm 4 projecting into the wheel seat 313. The transmission wheel set 5 is comprised of two wheels 51, 52 mounted on the wheel seat 313 at two opposite sides by a wheel axle 53, wherein the wheel 51 has a gear 511 fixedly attached thereto at an inner side and engaged with the worm 4 on the rear end 111 of the shaft 11 (see FIG. 5).

Therefore, rotating the fan 1 simultaneously causes the wheels 51, 52 to rotate. Further, the wheels 51, 52 each has a hole 513 or 523 at a suitable location for fastening either driving plate 61 or 62. The driving plates 61, 62 are respectively shaped like the lower part of the leg, each of which having two side pins 611, 612; 621, 622 at two opposite ends. By inserting the lower pins 611, 612 into the holes 513, 523, the driving plates 61, 62 are respectively connected to the two wheels 51, 52. The two driven plates 71, 72 are respectively shaped like the upper part of the leg, each of which having two holes 711, 712; 721, 722 at two opposite ends for inserting the pegs 321, 322 on the upper part 32 of the body 3 and the upper pins 612, 622 of the driving plates 61, 62 respectively. The base 8 has a support upstanding from a flat bottom 81 for supporting the body 3. The flat bottom 81 of the base 8 has holes 811 for fastening to a bicycle or any suitable supporting object by screws. A double-sides adhesive tape may be attached to the bottom edge of the flat bottom 81 so that the base 8 can be conveniently attached to a flat surface on a table, a wall or any suitable object.

Figure 4:
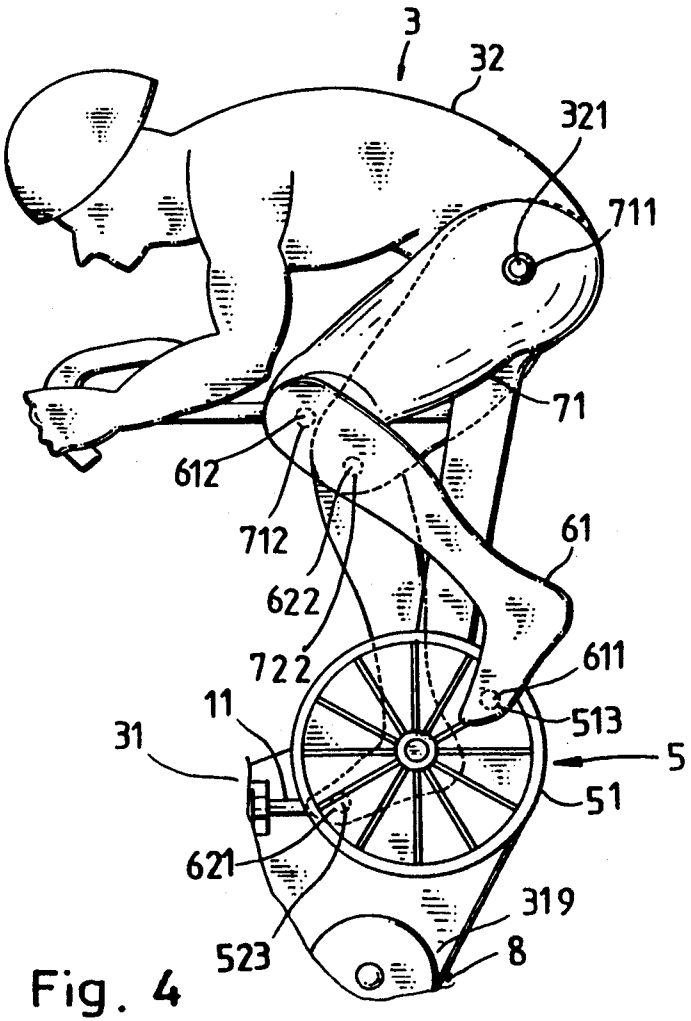
FIG. 4 is a side view showing that rotating the wheels cause the legs of the toy cyclist to alternatively rotate back and forth.

Referring to FIGS. 4 and 5 again, when a wind force in applied upon the fan 1 to rotate the shaft 11, the gear 511 is rotated by the worm 4 on the rear end 111 of the shaft 11, and therefore, the wheels 51, 52 are simultaneously rotated. When the wheels 51, 52 are rotated, the driving plates 61, 62 and the driven plates 71, 72 are simultaneously moved to alternatively rotate back and forth like the legs of a cyclist riding on a cycle.

I claim:

1. A wind force-operated cycling ornament, comprising:

a base, said base having a support upstanding from a bottom, said bottom having holes for fastening to a supporting surface by screws;

a body supported on said support of said base, said body comprising an upper part extending from a lower part, the upper part of said body being shaped like a cyclist and having two opposite pegs aligned at two opposite sides, the lower part of said body having a bearing holder to hold a bearing, and a wheel seat;

a fan mounted on said bearing holder, said fan having a shaft inserted through said bearing, said shaft having a rear end coupled with a worm and disposed in said wheel seat;

two transmission wheels mounted on said wheel seat at two opposite sides by a wheel axle, said transmission wheels including one wheel having a gear fixedly attached thereto at an inner side and disposed in mesh with said worm;

a pair of driven plates revolvably mounted on said pegs at two opposite sides, said driven plates being respectivley shaped like the upper part of the leg;

a pair of driving plates respectively connected between said pair of driven plates and said two transmission wheels, said driving plates each having one end fixedly respectively connected to said two transmission wheels and an opposite end revolvably respectively connected to said pair of driven plates; and wherein rotating said fan causes said two transmission wheels to rotate simultaneously, so that said pair of driving plates and said pair of driven plates are simultaneously moved to alternatively rotate back and forth.

* * * * *